US008214974B2

(12) United States Patent
Zhou et al.

(10) Patent No.: US 8,214,974 B2
(45) Date of Patent: Jul. 10, 2012

(54) CLIP FASTENERS FOR ATTACHING GASKETS OR GASKET-LIKE DEVICES TO A MOUNTING SURFACE AND ITS INSTALLATION METHOD AS WELL AS THE EQUIPMENTS

(76) Inventors: Yizhi Zhou, Jianshan (CN); Yousong Xiao, Shenzhen (CN)

( * ) Notice: Subject to any disclaimer, the term of this patent is extended or adjusted under 35 U.S.C. 154(b) by 748 days.

(21) Appl. No.: 12/314,142

(22) Filed: Dec. 4, 2008

(65) Prior Publication Data

US 2009/0144949 A1 Jun. 11, 2009

(30) Foreign Application Priority Data

Dec. 5, 2007 (CN) ..... 2007 1 0164481

(51) Int. Cl.
*F16B 5/12* (2006.01)

(52) U.S. Cl. ..... 24/458; 24/296; 52/718.07; 277/630; 277/637

(58) Field of Classification Search ..... 24/296, 24/452, 458, 626, 711.3, 546, 570; 52/718.07, 52/511; 29/521, 456, 888.3; 277/630, 637, 277/640, 652; 49/493.1
See application file for complete search history.

(56) References Cited

U.S. PATENT DOCUMENTS

| | | | | |
|---|---|---|---|---|
| 2,163,455 | A * | 6/1939 | Van Uum | 24/453 |
| 3,160,251 | A * | 12/1964 | La Penna et al. | 52/718.07 |
| 5,107,623 | A | 4/1992 | Weil | |
| 6,533,289 | B2 | 3/2003 | Bono, Jr. et al. | |
| 6,893,025 | B2 * | 5/2005 | Hight et al. | 277/630 |
| 7,093,838 | B2 * | 8/2006 | Hight et al. | 277/630 |
| 7,124,540 | B2 * | 10/2006 | Qiang | 49/492.1 |
| 7,464,461 | B2 * | 12/2008 | Hight et al. | 29/889.3 |
| 2009/0079141 | A1 * | 3/2009 | Qiang et al. | 277/650 |

* cited by examiner

*Primary Examiner* — Robert J Sandy
*Assistant Examiner* — Matthew Sullivan
(74) *Attorney, Agent, or Firm* — Jacobson Holman PLLC; Jiwen Chen

(57) ABSTRACT

The present invention provides a kind of clip fastener for attaching gaskets or gasket-like devices to a mounting surface, including a mounting surface engagement head, a neck and a protrusive base perpendicular to the plane of the head and attached to the neck. The present invention also presents a kind of method and equipment for mounting a clip fastener with protrusive base to gasket. Clip fastener base in present invention can be embedded into gasket, or rotated into woven gasket, or embedded into gasket being weaving. The head extend outwards across gasket and clip fasteners in the holes on mounting surface to fasten gasket to mounting surface firmly and effectively.

16 Claims, 6 Drawing Sheets

CLIP FASTENERS FOR ATTACHING GASKETS OR GASKET-LIKE DEVICES TO A MOUNTING SURFACE AND ITS INSTALLATION METHOD AS WELL AS THE EQUIPMENTS

FIELD OF TECHNOLOGY

The present invention covers a new kind of clip fastener for attaching gaskets or gasket-like devices to a mounting surface especially those for oven gasket, and a method of mounting this clip fastener to gasket and corresponding equipments.

BACKGROUND OF TECHNOLOGY

The doors of ovens, refrigerators and microwaves etc. have tubular gaskets around their perimeter for sealing and a variety of other reasons. This gasket is typically made of a combination of an inner tubular support member formed of knitted wire and an outer tubular member made either by braiding, knitting or weaving an insulating material such as fiberglass yarn. Such structures have proven to be durable at high temperatures used in self-cleaning ovens and provided a good sealing despite repeated openings and closures of the oven door over many years of use.

Methods of attaching a tubular gasket to oven door surface have typically comprised of providing several individual clip fasteners which extends along the gasket axial. Clip fasteners have heads and bases which are perpendicular to one another. Bases are embed into the gasket while heads projected out from gasket and inserted into the hole of the oven door to mount the gasket onto the oven door.

Several clip fasteners are presented in prior arts. For example, U.S. Pat. No. 6,893,025 presents a kind of gasket apparatus with clip fasteners. A clip fastener coming from a strand of elastic metal wire bent in a certain angle includes a diamond-shaped head and a base which is perpendicular to the plane of the head. The base comprises at least one coil course having a variable or constant radius of curvature and one tail. The tail typically bents downwards and separates from the last coil course. During many years of use, it is found that hands of operator are easily to be pricked when mounting gasket because of the up-wrapped tail. In addition, fiberglass is also easily to be pierced or lacerated which causes bad performance of gasket. Furthermore, as there is a tail in the clip, it is hard to be embedded into gasket when weaving. It has to be embedded into woven gasket by rotating and it is labor intensive process. When the base of clip fastener is more than one loop coil course, the multi-coil will easily cause the silk-spinning of fiberglass and affect sealing.

U.S. Pat. No. 5,107,623 presents a kind of loom-type weaving clip fastener which avoids intensive labor when rotating the clip fastener into gasket, but it brings another problem. As soon as the clip fastener is woven into gasket, it is hard to extract it again unless forced extraction. However, forced extraction will destroy the woven structure of fiberglass and bring heavy affection to sealing. When using this kind of clip, if any step is taken incorrectly, for example, wrong separation between clip fasteners or clip fasteners not in a line, total gasket will be rejected.

When mounting clip fasteners to gasket, clip fastener is mounted to gasket when fiberglass sheath is being woven. For example, in U.S. Pat. No. 6,533,289, an equipment for weaving fiberglass sheath weaves fiberglass sheath mounting clip fastener while weaving fiberglass sheath. In existing arts, most equipments take simple change or manual operation based on the equipment for weaving fiberglass sheath and the efficiency is low.

SUMMARY OF THE INVENTION

Present invention presents a kind of improved clip fastener for attaching gaskets or gasket-like devices to a mounting surface which can not only be rotated into woven gaskets, but also be embedded firmly while weaving.

This kind of clip fastener for attaching gaskets or gasket-like devices to a mounting surface consists of a single strand of resilient and bendable wire made of metal or other suitable materials. It includes a mounting surface engagement head, a neck and a base perpendicular to the plane of the head and connected to the neck. The head has an apex and a pair of shoulders. The shape of shoulders is typically symmetrical and the head extends from apex to shoulders. One of the shoulders twist into an end of the wire and the other one twists inwards to be an adjacent point to the end of wire. The thinnest portion of the shoulder is a neck. Other wire is a little tilted skew downwards from the neck and helically winds into the base. The neck locates over the plane of base and is protrusive. The longitudinal axis of the apex and neck is perpendicular to the base.

The coiled base is perpendicular to the plane of head and there is a protrusion on the ending portion of loop. The plane defined by protrusions is perpendicular to base. The other end of the wire is the terminal of protrusions. A subtle space is left near the coiled base and in the same plane of base.

A further embodiment of present invention is as follows: the plane defined by the protrusion on the coiled base is parallel to that of head and perpendicular to the base; or there are two protrusions on loop which define two planes parallel to that of head and perpendicular to the base.

As a further embodiment, one shoulder twisted to be an end of the wire, bends at the neck and transversely extend to form a transverse extension.

Transverse extension mentioned above is approximately parallel to the plane of coiled base and can, together with base, press the wall of an inner tubular support member closer to that of an outer tubular support member.

Length of transverse extension is ⅓~⅔ part of the radius of base and the optimum factor is ½. Keeping an appropriate length for transverse extension to fit base can press the wall of inner tubular support member closer to that of outer tubular support member, which can also save materials and avoid scraping the outer tubular member during mounting.

Restriction of transverse extension and base eliminates the gap between the inner tubular support and the outer tubular support. When mounting the clip fastener, transverse extension will prevent the head to be squeezed into neither the inner tubular support nor the outer tubular support.

Present invention also provides a method of mounting a clip fastener with a protrusive base to a gasket. The steps are as follows:

(a) Tightly grasping the head of clip fastener (b) Squeezing the protrusion of base to separate the end of base from base plane.

(c) Extending gasket and clip fastener toward one another until end of clip fastener base is inserted into gasket.

(d) Rotating clip fastener around the axis defined by apex of head and neck to insert base into gasket.

Present invention also provides an equipment to realize the method above. This equipment can rotate the base of clip fastener into a composite gasket made of metal wire framework and fiberglass through a rotatable nose grasping clip fastener head. It can mount clip fastener to gasket automatically and rapidly.

The equipment for mounting a clip fastener with protrusive base to gasket comprise of: rack designed with several rotatable noses and one gasket apparatus which can move in relation to noses back and forth alternatively. Heads mentioned above has a narrow channel to locate the head of clip fastener at the front part. The narrow channel divided the front part into two parts. One part in relation to the other part along the nose axis has axial protrusions used to squeeze the protrusions of the base of clip fasteners. Gasket apparatus comprises groove and squeezing block in the grove used to squeeze gasket. On the lateral wall of groove towards heads is back plate. There are several side openings on a back plate used to pass clip fasteners. When the gasket apparatus moves and reaches noses, the gasket is rotated into the base by the noses.

In order to adjust the gap between clip fasteners in the gasket, there is a rail parallel to the groove of gasket apparatus on the rack mentioned above. Several heads are fixed on rail by respective nose base. The distance between nose bases is adjustable and fastened to the rail by screw. Herein nose is multidiameter and has an impetus converter at the end of itself.

With respective impetus converter, herein all several noses are connected to a motor-drive main shaft. There are several impetus output blocks on a main shaft working together with the impetus converters of the noses.

Impetus converter of heads and impetus output block are gears engaging to each other. The main shaft drives respective heads through impetus converter of heads and impetus output block.

Several rails used to support gasket apparatus are designed on the rack. At the bottom of the gasket apparatus, there are several drive arms connected to and driven by drive apparatus, to move gasket apparatus back and forth alternatively along rail.

At the rack along which the gasket apparatus reciprocates, the first photosensor and second photosensor are located at the end of the rack, respectively, to monitor the position of gasket apparatus. When the gasket apparatus approaches the nose, first photosensor sends out an electrical signal to rotate the nose. When the gasket apparatus return to initial position, the second photosensor sends out an electrical signal to reverse the nose.

The gasket apparatus also includes a groove cover hinged with a lateral wall of groove. At one end of the groove cover and one end of the groove, there is a piece of blade, respectively. When the groove cover is closing towards the groove, the blades on the groove cover and the groove engage together to cut off gaskets in the groove.

The grip block used to fasten gasket ends is designed at one end of gasket apparatus. One end of grip block is mounted in groove by a pin roll and a hand knob is mounted to the center potion of grip block by a connecting rod.

One end of main shaft is connected to an adjusting revolving tray to control the rotation angle of every nose. The angle of every narrow channel of noses can be adjusted by revolving tray thus to make all narrow channel horizontal for easy mounting of the clip.

For the sake of automatic control, the drive apparatus, used to rotate nose and move gasket apparatus and to move back and forth alternatively, can be inserted into a control apparatus, together with the first photosensor and second photosensor of gasket apparatus to implement automatic control.

For clip fasteners embedded to a gasket, its base is completely in the cavity between tubular gaskets. Its head extends out from woven sheath of gasket. There is a sharp apex in the head of clip fastener which can be inserted to the hole about 3.9 mm wide on the door of oven. Two shoulders shrink due to pressure from the hole, which make the head easy to cross the hold on the door of oven. When the head passes the hole, the shoulders recover the initial size. Because the distance between the two shoulders is larger than the hole, the head of the clip fastener can be clipped in the hole of the oven, and the gasket is mounted on the door of the oven.

The structure of clip fastener in present invention is simple and effective. Protrusions on base ensure a firm and effective attaching of gasket and mounting surface. The neck separated from the plane of base ensures that clip fasteners can be rotated out easily from gasket without damage to woven structure. Furthermore, one end of metal wire on base is in the same plane of base and has no up-wrapped tail, which prevents the metal wire of clip fasteners from pricking fiberglass and hands of operator during mounting. Using method and equipment in present invention to mounting clip fasteners can dramatically improve the efficiency of mounting and realize the automation of clip fastener mounting.

DETAILED DESCRIPTION OF THE EMBODIMENTS

Embodiment Example Clip Fastener with Protrusions on Base

Figure 1:
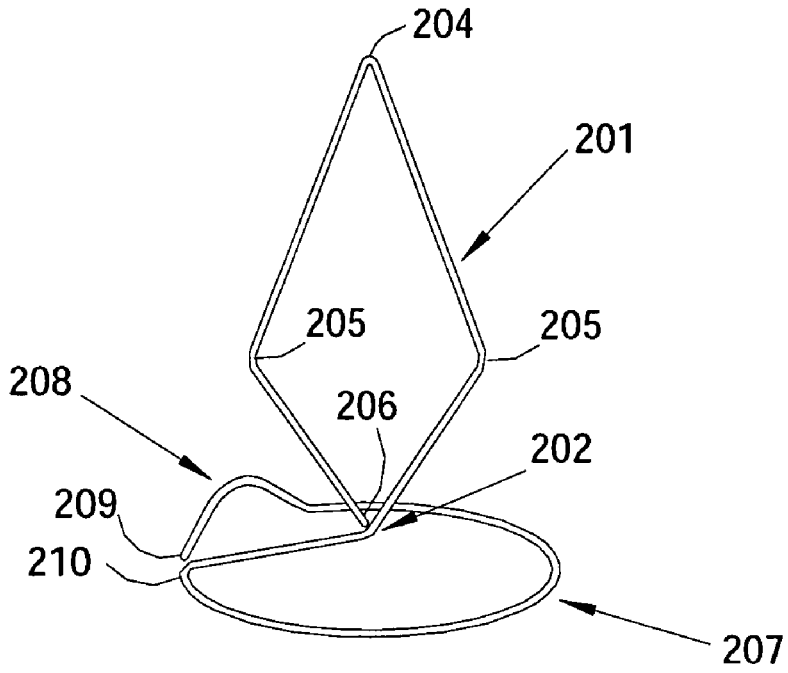
FIG. 1 is a three-dimensional figure of the clip fastener in present invention. The protrusions locate at the end of coiled base.
Figure 2:
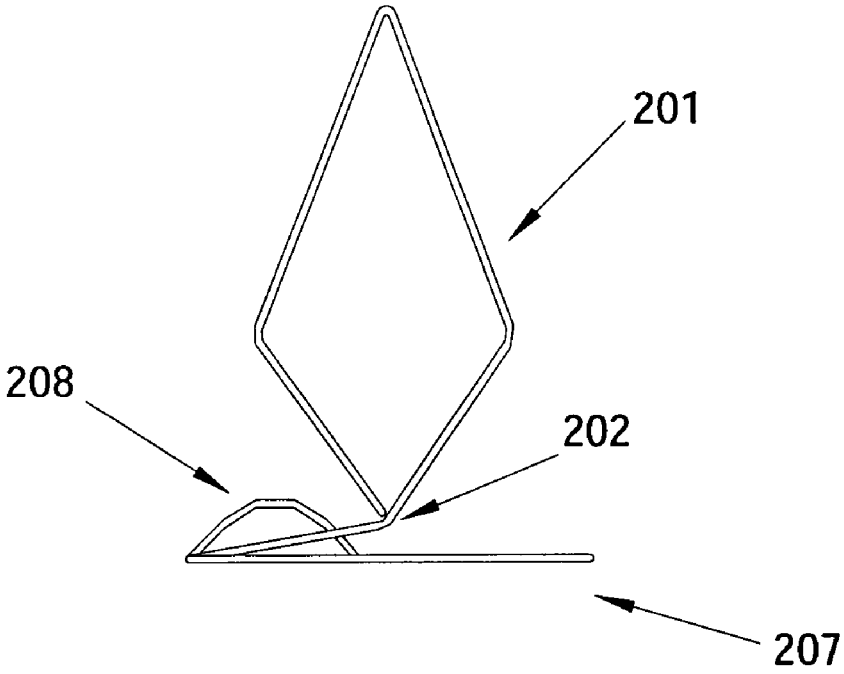
FIG. 2 is front view of clip fastener in FIG. 1.

As FIG. 1 and FIG. 2 depicted, one kind of clip fastener for attaching gaskets or gasket-like devices to a mounting surface, consists of a single strand of resilient and bendable wire make of metal or other suitable materials, typically stainless metal such as 304ss semi-rigid stainless metal. The cross section of metal wire is typically orbicular with a diameter of 0.5~0.8 mm, typical value is 0.635 mm. The clip fastener includes a mounting surface engagement head 201, a neck 202 and a base 207 perpendicular to the plane of the head and connected to the neck. The head 201 has a sharp apex 204 and a pair of shoulders 205. The shape of shoulders is typically symmetrical and the head 201 extends from apex 204 to shoulders. One of the shoulders twist into an end 206 of the wire and the other one twists inwards to be an adjacent point to the end 206 of wire. The thinnest portion of shoulder is neck 202. The remainder wire is a little skew downwards from neck 202 and helically winds into base 207. Neck 202 locates 0.8~1.0 mm over the plane of base 207. The longitudinal axis of the apex 204 and neck 202 is perpendicular to the base. Coiled base 207 is perpendicular to the plane of head 201 and there is a protrusion 208 on the ending potion of loop. The plane defined by protrusions is perpendicular to base. The other end 209 of wire is the terminal of protrusions close to the beginning 210 of coiled base but 0.3~0.4 mm spaced and it is in the same plane of base.

The protrusion of clip fasteners in this embodiment is 1.0-1.5 mm and 4.0-5.0 mm long (from the beginning of protrusion to the termination).

The optimized size of the head of clip fastener in this embodiment: the vertical distance between base 207 and shoulders 205 is about 3.3 mm, the distance between base 207 and apex 204 of the clip fastener is about 10.4 mm, the width between the shoulders is about 4.8 mm, the height of the protrusion is 1.5 mm and the length of it is 4.5, and the vertical distance between base 207 and neck 207 is 1.0 mm.

Embodiment Example 2

The Second Kind of Clip Fastener with Protrusions on Base

Figure 3:
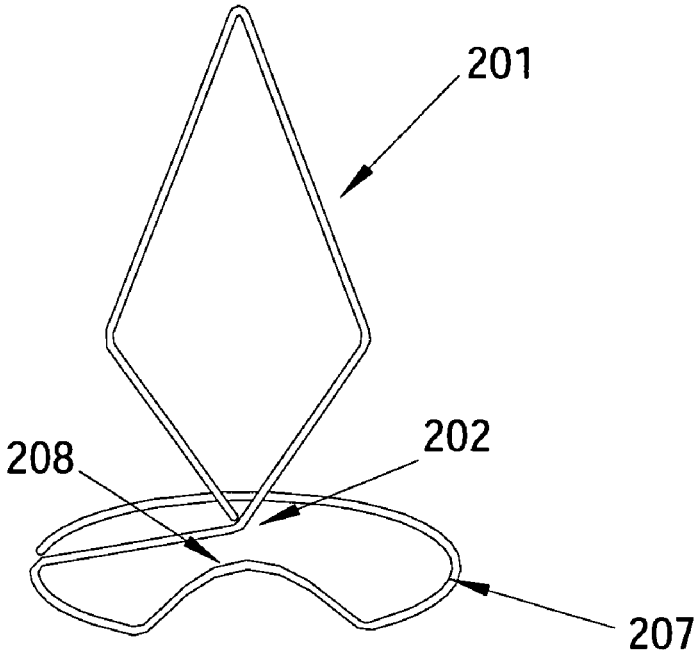
FIG. 3 is a three-dimensional figure which depicts a second embodiment of clip fastener in present invention. The protrusions locate far from the end of coiled base.

FIG. 3 depicts another embodiment of the clip fastener in present invention. The plane defined by protrusions 208 is parallel to the plane of head 201 and perpendicular to base 207. The protrusion locates far from the terminal of the base loop and on another side of the end of coiled base.

The best size of clip fastener in FIG. 1 is also applicable to the clip fastener in this embodiment.

Embodiment Example 3

The Third Kind of Clip Fastener with Protrusions on Base

Figure 4:
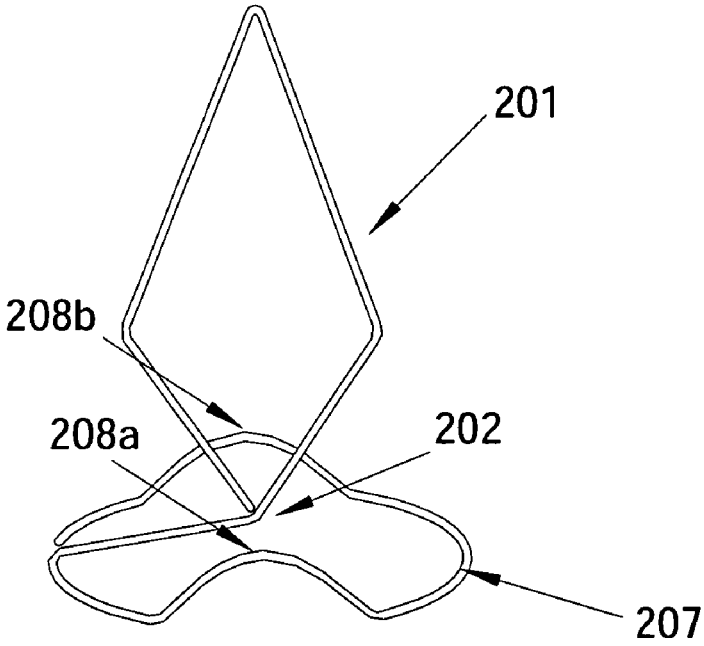
FIG. 4 is a three-dimensional figure which depicts a third embodiment of clip fastener in present invention. There are two protrusions parallel to the head in the coiled base.
Figure 5:
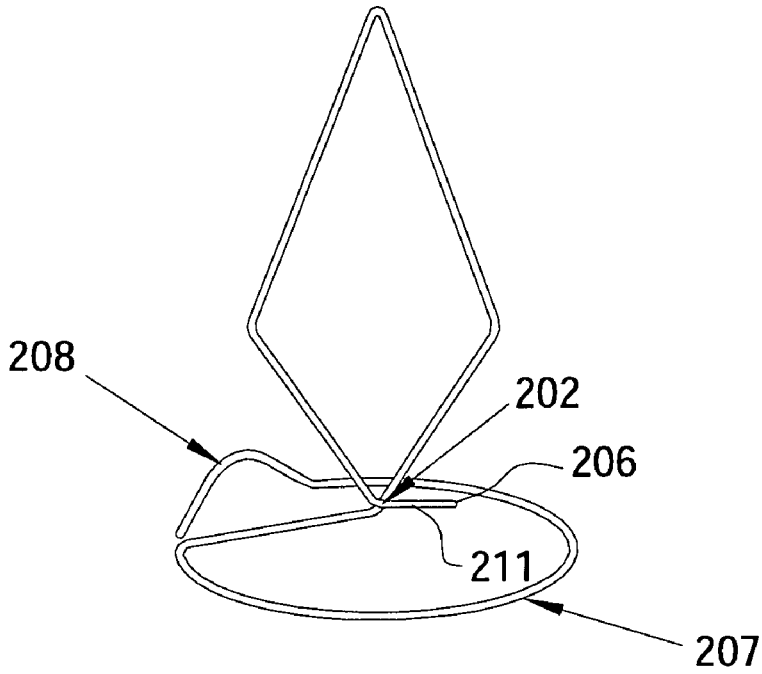
FIG. 5 is a three-dimensional figure which depicts a forth embodiment of clip fastener in present invention. The neck has transverse extension.
Figure 6:
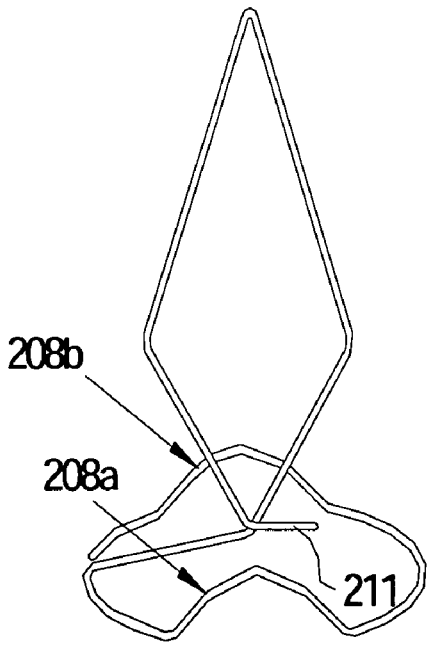
FIG. 6 is a three-dimensional figure which depicts a fifth embodiment of clip fastener in present invention. The neck has transverse extension and there are two protrusions parallel to the head in the coiled base.

FIG. 4 depicted another improved kind of clip fastener whose base 207 loop has two protrusions 208*a* and 208*b*. The planes defined by these two protrusions are parallel to head 201 and perpendicular to base 207.

It is better for the clip fastener with two protrusions when mounting: first rotating the clip fastener into inner tubular support and then weaving fiberglass sheath around the clip fastener thus to improve the automation.

Embodiment Example 4

The Forth Kind of Clip Fastener with Protrusions on Base

As a further embodiment, except the protrusion 208 on base, one shoulder twisted to be an end 206 of the wire and this end 206 of wire bends at the neck 202 and transversely extend to form transverse extension 211.

Transverse extension 211 is approximately parallel to the plane of coiled base 207 and can pressed the wall of inner tubular support member closer to that of outer tubular support member together base 201. Length of transverse extension 211 is ½ part of the radius of base and. An appropriate length for transverse extension 211 fitting with base 207 can press the wall of inner tubular support member closer to that of outer tubular support member thus the material is saved and outer tubular support will not be scraped.

Embodiment Example 5

The Fifth Kind of Clip Fastener with Protrusions on Base

In this embodiment, the base has two protrusions 208*a* and 208*b*. The end of wire 206 bends at the neck 202 and transversely extends to form the transverse extension 211.

The clip fastener in present invention also has many variations and modifications. The detailed structure is not only limited to the embodiment mentioned above. For example, except hemicycle, the protrusion can also be trapeze or other shape; protrusions can locate anywhere around the base; number of protrusions can be increased or decreased if required. In general, present invention also intends to cover any easy modifications for the technologist.

Embodiment 6

Method of Mounting

A method of embedding clip fasteners into gasket is as follows: as there is a gap of 0.3~0.4 mm between the terminate of coiled base, i.e. one end of metal wire 209 and the beginning 210 of coiled base, it is helpful to separate the end of wire 209 from the base 207 by pressing protrusion. First the end of wire 209 is inserted into woven sheath, and then pressed into woven sheath and rotated it until it hangs on some wire in the inner tubular support of gasket. After that, the clip fastener is rotated around the longitudinal axis of apex 204 and neck 202. Then the base 207 will cross woven sheath and inner tubular metal support and thereafter is fully under the metal wire of inner tubular support.

Figure 7:
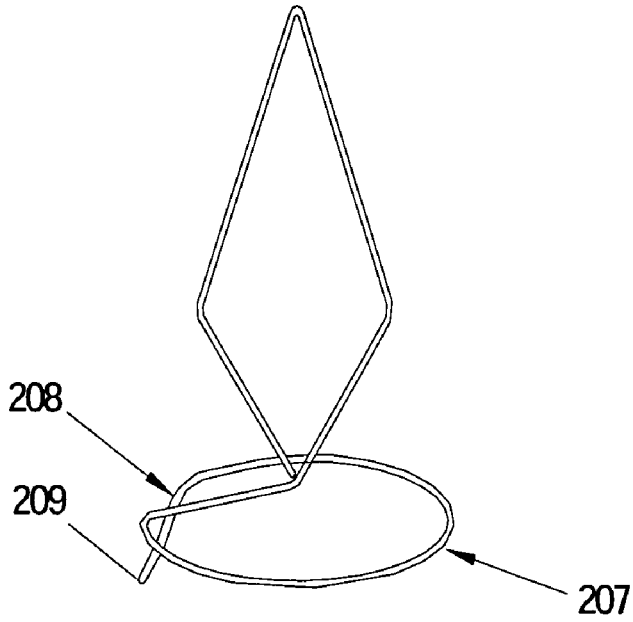
FIG. 7 is a structure sketch of clip fastener base protrusions deformation after squeezed.

Steps of mounting clip fastener in present invention to gasket:

(a) Tightly grasping the head (201) of clip fastener (b) Squeezing the protrusion 208 of base 207 to separate the end of base from base, see FIG. 7.

(c) Extending gasket and clip fastener toward one another until the end 209 of clip fastener base is inserted into gasket.

(d) Rotating clip fastener around the axis defined by apex 204 of head and neck 202 to insert base 207 into gasket.

All the clip fasteners depicted in FIG. 1~6 can be mounted by adopting the method mentioned in present invention. In addition, the clip fastener also has many variations and modifications. The detailed structure is not only limited to the embodiment mentioned above. For example, how to fasten the head of clip fastener and what equipment to be used is variable depending on current technology. When squeezing the protrusions on base, more than one tool or single special shaped tool can be used. In general, present invention also intends to cover other easy changes for the technologist.

Embodiment 7

Equipment

Refer to FIG. 8~11; present invention provides an equipment for mounting a clip fastener with protrusion to gasket.

The equipment includes a rack 100 and there are several rotatable noses 11 and one gasket apparatus which can move back and forth alternatively in relation to noses 11.

Figure 9:
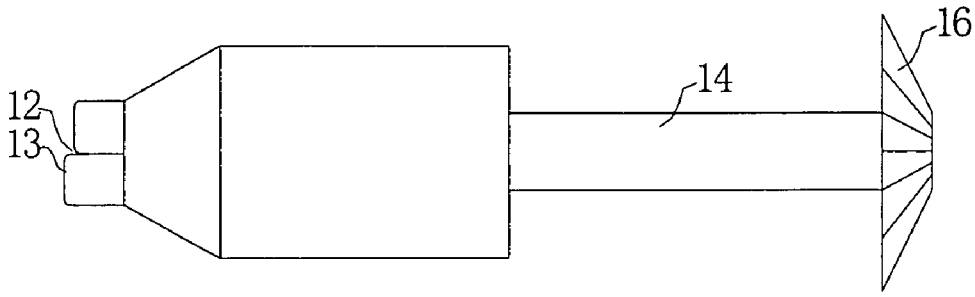
FIG. 9 is a structure sketch of noses in clip fastener mounting equipment in present invention.

It can be more clearly seen from FIG. 9 that noses 11 is multidimeter and there is a flat narrow channel 12 locating the front of nose to place clip fastener. Two subassemblies are formed at the front end of noses 11 divided by narrow channel. One subassembly in relation to the other subassembly has protrusion in an axial direction. Clip fasteners are mounted to the narrow channel 12 of noses 11 with the protrusions blocked by the axial protrusion thus the end of clip fastener 209 is separated outwards from the plane of base 207. Gasket apparatus moves the gasket closer to clip fastener and pricks the end 209 of clip fastener into gasket and then rotate the end 209 of clip fastener into gasket by noses 11.

Figure 8:
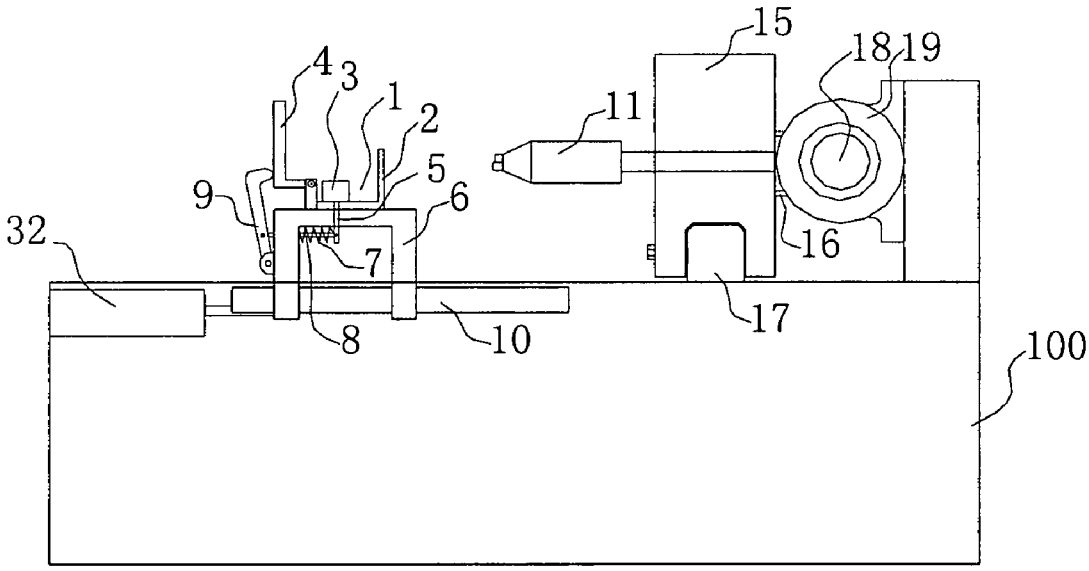
FIG. 8 is a structure sketch of clip fastener mounting equipment in present invention.
Figure 10:
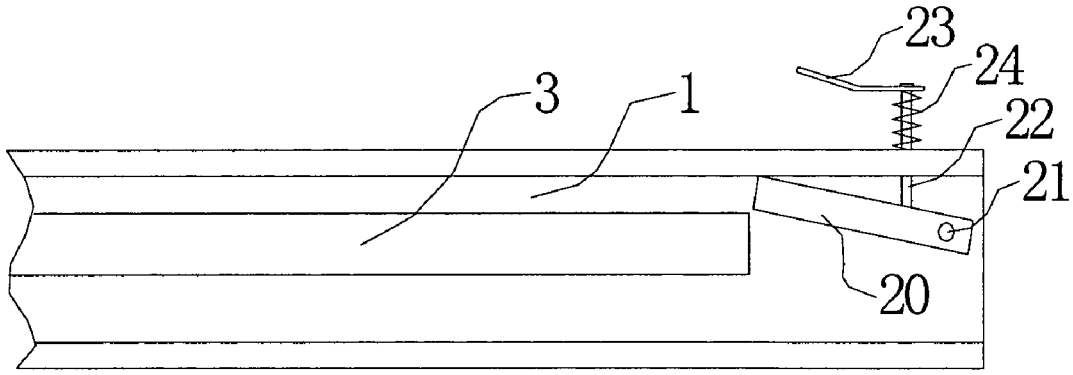
FIG. 10 is a structure sketch of grip block in clip fastener mounting equipment in present invention.

Referring to FIG. 8 and FIG. 10, gasket apparatus and noses 11 are placed on the rack 100 abreast. Gasket apparatus includes groove 1 to place gasket. On right back plate 2 of groove 1, there are side openings in horizontal array to pass the clip fastener into gasket. A row of little hole related to noses 11 is depicted in the figure. In groove 1 there is a squeezing block 3. When gasket is placed into groove 1 and groove cover 4 is covered, squeezing block 3 will push the gasket to the right back plate 2 of groove 1. At bottom of squeezing block 3 there is a drive rod 5 fixed vertically. Accordingly, there is a rail to stretch drive rod 5 outwards at bottom of groove. As squeezing block 3 moves, drive rod 5 will move along the rail. In base 6 below groove 1, there is a spring 7. One end of the spring 7 is fastened to the left lateral wall of base 6 and the other end is fastened below to drive rod 5. Elastic force will impel drive rod 5 and squeezing block 3 to move towards right back plate 2 of groove 1. At the bottom of drive rod 5 there is a connecting rod which pass through left lateral wall of base and then connected to the central section of the lever 9 outside base 6. Base 6 is connected actively to the lower end of lever 9 and can rotate around the bottom subassembly. The upper end locates at the opening of groove cover 4. Groove cover 4 and the left back plate of groove 1 are connected actively through hinge. As soon as groove cover 4 is opened and inverts to the left side, groove cover 4 will touch on the upper end of lever 9 to cause lever rotate around the lower end. In this way, connecting rod 8 will be draught, drive rod 5 slides to the left side and at the same time squeezing block 3 slides to the left side. Then it is time to replace gasket. After the gasket is replaced, close groove cover and no force is applied to the upper end of lever. Then drive rod 5 will slide to the right side and squeeze the gasket to the right back plate 2 in the action of elastic force.

Figure 11:
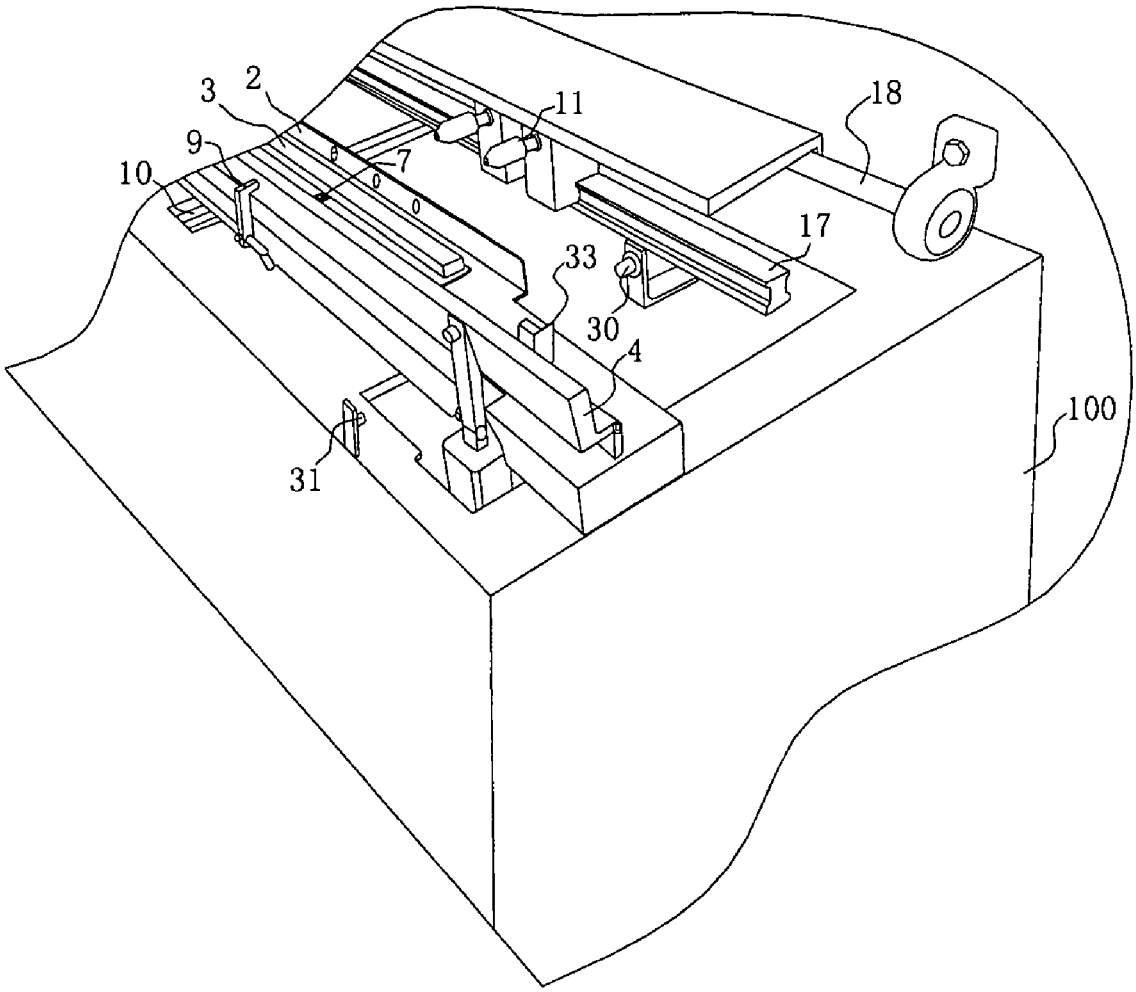
FIG. 11 is a partial three-dimensional structure sketch of clip fastener mounting equipment in present invention.

There are blades fixed at one end of groove cover 4 and groove 1 each, and lower blade 33 in groove 1 can be seen in FIG. 11. When gasket is placed correctly and groove cover 4 is closed, groove cover and groove engage together to cut off gaskets in groove.

On the right side of gasket apparatus there are noses 11 for clip fastener mounting. When gasket apparatus move to noses 11, the clip fastener over nose 11 will enter into gasket through the little hole of right back plate. Base of gasket apparatus is set on rail 10. At the bottom of gasket apparatus, there are several drive arms connected to drive apparatus 32, which can move gasket apparatus back and forth alternatively along rail 10. Drive apparatus 32 can be air-actuated, hydraulic or electric-driven. Its impetus output rod is connected to drive arm.

First photosensor 30 is located on rack 100 of gasket apparatus where it is close to noses 11. When gasket apparatus is ready and the end 209 of clip fastener is pricked into gasket, first photosensor 30 send out signal to rotate noses 11. Clip fastener fastened on noses 11 also begins to rotate and separate the end 209 from the plane of the base 207 and rotate base 207 into the metal mesh in gasket. After base 207 is rotate into gasket, gasket apparatus will move back to initial position, drag clip fastener out from nose 11, and then get gasket with clip fastener from the groove 1 of gasket apparatus. Second photosensor 31 is set on rack 100 near an initial position of gasket apparatus. When gasket apparatus comes back to the initial position, second photosensor 31 sends out a signal to reverse noses 11 back to the initial state.

All noses 11 are fixed on rail 17 by nose base 15. Rotor 14 behind noses 11 is set in the bearing of corresponding nose base. A gear 16 is fixed behind rotor 14. Head base 15 is fixed on rail 17 by screws. Loose screws to slide head base 15 along rail 17, to adjust the distance between different bases 15 and sequentially adjust the distance of clip fasteners in gasket.

It can be seen in FIG. 8 that main shaft 18 driven by motor is fixed behind noses 11 by bearing base 19. Main shaft 18 is perpendicular to rotor of noses 11. Number of gear fixed on main shaft 18 is same as that of noses 11. These gears engage with gear 16 behind corresponding rotor of heads. When main shaft 18 rotates, each nose 11 is driven through gears. Initially, each narrow channel 12 of nose 11 is horizontally which makes it easy to mounting clip fastener on noses 11. As first photosensor 30 sends out signal, the motor drive main shaft 18 and noses 11 to rotate the clip fastener into gasket. Then the gasket apparatus will return to initial position under the action of drive arm and clip fastener falls from noses 11. After second photosensor 31 sends out signal, motor drive main shaft 18 to reverse noses 11 and thus narrow channel 12 returns to horizontal state. A revolving tray is fixed to main shaft 18. When narrow channel of noses 11 is not horizontal, adjust revolving tray to rotate main shaft and keep narrow channel horizontal.

See FIG. 10, there is a grip block apparatus used to grip gasket ends at one end of gasket apparatus. In groove 1 of gasket apparatus, one end of grip block 20 is mounted to groove by a pin roll 21 and the grip block 20 can rotate around the pin roll 21. Connecting rod 22 is fixed in the center part of grip block and passes through lateral wall of groove. One hand knob 23 is fixed at the outside end. A spring 24 is hitching between connecting rod 22 and groove 1.

For the sake of automatic control, drive apparatus used to rotate noses 11 and move gasket apparatus move back and forth alternatively can be inserted into a control apparatus, together with first photosensor 31 and second photosensor 32 of gasket apparatus to implement automatic control.

The equipment in present invention also has many variations and modifications. The detailed structure is not limited to the embodiment mentioned above. For example, power supply and driving mode of all locomotive subassemblies can be different styles based on current technology; grip block used to grip the ends of gasket and the position or structure of blades used to cut gasket can also be different styles based on current technology. Control apparatus for automotive control can be singlechip or microcomputer etc. and can be located on integrated rack or individually set up. In general, present invention should also cover other easy variations or modifications for the technologist.

The invention claimed is:

1. A clip fastener for attaching gaskets and gasket-like devices to a mounting surface consists of a single strand of resilient metal wire, said fastener comprising a mounting surface engagement head, a neck and an annular base perpendicular to the plane of the head and attached to the neck; the head with an apex and a pair of shoulders extended from the apex to the shoulders, wherein one of the shoulders twists into an end of the metal wire and the other one of the shoulders twists inward to be an adjacent point to the end of the metal wire, forming into the neck at the thinnest portion of the shoulders; a portion of the metal wire connecting the neck and the base is slightly tilted downwards from the neck and forms an acute angle with the plane of the base and then the metal wire helically winds into the annular base, the neck is spaced apart from and above the base; there are wave shaped protrusions on the base, and the plane of protrusions is perpendicular to the base; another end of the wire close to a beginning of the base annulus but left with space is in the same plane as the base.

2. The fastener as claimed in claim 1, characterized in that the wave shaped protrusions are located at the end of the base annulus, where said another end of the metal wire is the end of the protrusions and the plane defined by the protrusions is perpendicular to the base.

3. The fastener as claimed in claim 1, characterized in that there are two wave shaped protrusions on the base annulus, where the planes defined by two wave shaped protrusions are both parallel to the head and are perpendicular to the base.

4. The fastener as claimed in claim 1, characterized in that the wave shaped protrusions are 1.0~1.5 mm high and 4.0~5.0 mm long.

5. The fastener as claimed in claim 1, characterized in that vertical distance between the neck and the base (207) is 0.8~1.0 mm, and there is an interspace between one end of the metal wire in base and the beginning of the base annulus within the range of 0.3 to 0.4 mm.

6. The fastener as claimed in claim 1, characterized in that in the shoulder of one twisted end, the end of the metal wire bends at the neck and transversely extends to form a transverse extension.

7. The fastener as claimed in claim 6 characterized in that the transverse extension is approximately parallel to the plane of the base and its length is ⅓~⅔ of the radius of the base.

8. A method for mounting a clip fastener with the wave shaped protrusive base as defined in claim 1 to the gasket, comprising the steps of:

(a) providing the clip fastener of claim 1;

(b) tightly grasping the head of the clip fastener, (c) extruding the wave shaped protrusion of the base to separate the end of the base from the base, (d) extending the gasket and the clip fastener closer to one another until the end of the clip fastener base has been inserted into the gasket, and (e) rotating the gasket around the axis defined by the apex of the head and the neck to insert the base into the gasket.

9. An equipment practicing the method of claim 8 and including a plurality of clip fasteners, each clip fastener as claimed in claim 1, comprising; a rack, characterized in that said rack has a plurality of rotatable noses and a gasket placement apparatus which can move back and forth alternately in relation to a nose; at the front end of the said nose there is a narrow channel used to hold the head of one of said clip fasteners, and two subassemblies are formed at the front end of said plurality of noses divided by the narrow channel, wherein one subassembly in relation to the other one along the revolution axis has axial protrusions used to squeeze the wave shaped protrusions of the base of the clip fastener; said gasket placement apparatus comprises a bar groove and a squeezing block used to squeeze a gasket in said bar groove; on a lateral wall of the said groove towards one of said noses is a baffle where there are several lateral openings on the baffle used to allow the clip fasteners to pass, and when the gasket placement apparatus moves and reaches said plurality of noses, the clip fastener is rotated into the gasket by a one of the noses through the lateral openings.

10. The equipment of claim 9, characterized in that on said rack there is a rail parallel to the groove of said gasket placement apparatus, and said plurality of noses are fixed on the rail by respective nose bases, wherein one of said noses is multi-diameter and has an impetus converter at the end of itself with a respective impetus converter, all noses are connected to a motor-drive main shaft, where there are several impetus output blocks on the said main shaft working together with said noses.

11. The equipment of claim 10, characterized in that the said impetus converter of said noses and the said impetus output block of main shaft are gears engaging each other.

12. The equipment of claim 11, characterized in that said rails used to support said gasket placement apparatus are set on said rack, and at the bottom of said gasket placement apparatus, there are drive arms connected to the drive apparatus, where the drive apparatus drives said drive arms and moves said gasket placement apparatus back and forth along said rail.

13. The equipment of claim 12, characterized in that there is a first photosensor and a second photosensor located on the rack to monitor the position of said gasket placement apparatus.

14. The equipment of claim 13, characterized in that said gasket placement apparatus also includes a groove cover hinged with a side wall of the groove, where there is a piece of blade each at one end of said groove cover and groove, when the groove cover is closing towards the groove, the blades on the groove cover and the groove engage together to cut off the gaskets in the groove.

15. The equipment of claim 14, characterized in that a grip block used to fasten gasket ends is set at one end of the gasket placement apparatus, where one end of said grip block is mounted in the groove by a pin roll and a hand knob is mounted to the center portion of grip block by a connecting rod.

16. The equipment of claim 15, characterized in that one end of the said main shaft is connected to an adjusting revolving tray to control the rotation angle of every nose.

* * * * *